US008983339B2

(12) United States Patent
Lee

(10) Patent No.: US 8,983,339 B2
(45) Date of Patent: Mar. 17, 2015

(54) DEVELOPING CARTRIDGE WITH SHAFT AND TUBULAR MEMBER AND IMAGE FORMING APPARATUS HAVING THE SAME

(75) Inventor: Yong-hoon Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 261 days.

(21) Appl. No.: 13/530,348

(22) Filed: Jun. 22, 2012

(65) Prior Publication Data

US 2013/0136501 A1 May 30, 2013

(30) Foreign Application Priority Data

Nov. 24, 2011 (KR) ..... 10-2011-0123728

(51) Int. Cl.
*G03G 15/02* (2006.01)
*G03G 21/18* (2006.01)

(52) U.S. Cl.
CPC ..... *G03G 15/0233* (2013.01); *G03G 21/1814* (2013.01); *G03G 21/1867* (2013.01)
USPC ..... 399/176

(58) Field of Classification Search
USPC ..... 399/176, 174, 168, 115, 50
See application file for complete search history.

(56) References Cited

U.S. PATENT DOCUMENTS 5,534,344 A * 7/1996 Kisu et al. ..... 428/323
6,684,043 B1 1/2004 Zona et al.
2009/0142099 A1* 6/2009 Oshima ..... 399/176

FOREIGN PATENT DOCUMENTS

JP 2002-116608 4/2002

OTHER PUBLICATIONS

Extended European Search Report issued in Application No. 12184902.0 on Jul. 21, 2014.

* cited by examiner

*Primary Examiner* — Billy Lactaoen
(74) *Attorney, Agent, or Firm* — Staas & Halsey LLP

(57) ABSTRACT

A developing cartridge includes a photoconductive body, a charging unit which charges a surface of the photoconductive body and a developing unit which forms a toner image. The charging unit includes a shaft which applies a charging voltage and which has a central axis parallel to a rotating axis of the photoconductive body, a tubular member of a conductive material which surrounds the shaft, a current carrying member which applies an electric current to the shaft and the tubular member, and a damping member which is disposed between the shaft and the current carrying member. The shaft has a middle portion which is thicker than opposite end portions in a longitudinal direction along the central axis.

17 Claims, 11 Drawing Sheets

DEVELOPING CARTRIDGE WITH SHAFT AND TUBULAR MEMBER AND IMAGE FORMING APPARATUS HAVING THE SAME

CROSS-REFERENCE TO RELATED APPLICATIONS

This application claims the benefit under 35 U.S.C. §119 from Korean Patent Application No. 10-2011-0123728, filed on Nov. 24, 2011, in the Korean Intellectual Property Office, the disclosure of which is incorporated herein by reference in its entirety.

BACKGROUND OF THE INVENTION

1. Field of the Invention

The present general inventive concept relates to a developing cartridge and an image forming apparatus having the developing cartridge, and more particularly, to a developing cartridge which includes a charging unit using a tubular member and an image forming apparatus which has the developing cartridge.

2. Description of the Related Art

An image forming apparatus such as a printer, facsimile, copier, multifunction peripheral (MFP) and the like forms a prescribed image in a print medium using electrophotography. In general, such an image forming apparatus consists of charging, exposure, development, transfer of a developed image, and fixing processes so as to form an image on a print medium. In the charging process, a charging unit charges a photoconductive body to a prescribed electric potential. In the exposure process, a laser scanning unit scans the photoconductive body charged to the prescribed electric potential with a laser so as to form an electrostatic latent image corresponding to printing data on the photoconductive body. In the development process, a developing unit develops a toner image by supplying toner to the photoconductive body on which the electrostatic latent image is formed. In the transfer process, a transfer unit transfers the toner image formed on the photoconductive body to the printing data. In the fixing process, a fixing unit fixes the toner transferred to the printing data, thereby forming a prescribed image in the print medium. Thereafter, the print medium is discharged outside the image forming apparatus and the printing is completed.

A charging unit may be generally divided by using a non-contact charging system or contact charging system. A charging unit according to the non-contact charging system uses corona discharge typically. The charging unit using the corona discharge has the advantage of charging a photoconductive body uniformly, but leads to producing discharge products such as ozone. Therefore, a separate unit is required to dispose of the discharge products such as ozone, etc., and this addition of a separate unit results in increasing a size of the image forming apparatus and costs for manufacturing the same.

A charging unit using the contact charging system may be divided by using a conductive roller, a conductive brush, a film-shaped charging electrode or a tube-shaped structure, etc.

A charging unit employing the conductive roller needs a support device for the roller and the like, and has a complex construction. An elastic roller must be in close contact with a charge acceptor so that a stable minute gap is formed to charge the charge acceptor uniformly, and hence, the hardness of rubber must be comparatively low. Such rubber contains a comparatively large amount of process oil. Such a charging unit has a problem of affecting image quality adversely due to contamination of a surface of the charge acceptor, caused by the process oil. Further, a rubber roller should be in a higher dimensional accuracy, and this leads to increasing the manufacturing costs.

A charging unit employing the conductive brush is advantageous in uniform contact, as compared with the elastic roller. However, the conductive brush is manufactured at a high manufacturing cost and is likely to form brush marks that cause irregular charging adversely affecting the image.

A charging unit employing the film-shaped charging electrode vibrates due to frictional electrification because a working edge of the film-shaped charging electrode is in contact with the charge acceptor, whereby the charging potential is liable to be caused to become unstable. Furthermore, if foreign matters, such as toner and additives, adhere to the working edge of the film-like charging electrode, creeping discharge occurs to cause defective stripes of charges. A method to solve such a problem applies both a DC voltage and an AC voltage simultaneously to the film-shaped charging electrode. However, the AC voltage generates vibrations resonant with the frequency of the AC voltage and generates charging noise.

A charging unit employing the cylindrical (tube-shaped) structure has problems such as a slip phenomenon of a tubular member occurring due to a frictional force produced between the tubular member and an elastic member, and also a bias occurring due to an axial force resulting from the pressure difference between left and right when being driven for rotation.

SUMMARY OF THE INVENTION

The present general inventive concept relates to a developing cartridge and an image forming apparatus having the same.

Additional features and utilities of the present general inventive concept will be set forth in part in the description which follows and, in part, will be obvious from the description, or may be learned by practice of the general inventive concept.

Embodiments of the general inventive concept include a developing cartridge having a photoconductive body, a charging unit which charges a surface of the photoconductive body, and a developing unit which forms a toner image by supplying toner to the surface of the photoconductive body according to an aspect of the present general inventive concept, the charging unit includes a shaft applying a charging voltage and having a central axis parallel to a rotating axis of the photoconductive body, a tubular member of conductive material surrounding the shaft, which is disposed to be in contact with the surface of the photoconductive body, a current carrying member which is disposed on an inner surface of the tubular member and applies an electric current to the shaft and the tubular member, and a damping member which is disposed between the shaft and the current carrying member, and the shaft may be characterized in that a middle portion is thicker than opposite side portions in a longitudinal direction along the central axis.

The shaft may be formed in a cylindrical shape and a diameter may increase with being close to the middle portion.

A protrusion of the middle portion of the shaft may be in the range of 0.14 mm-0.35 mm in a direction of the photoconductive body.

The shaft may consist of an injection molding.

The tubular member may consist of conductive nylon.

The current carrying member may have a surface resistance of less than $10^8\Omega$.

The damping member may be an elastic member having elasticity.

The damping member may consist of a foam.

Embodiments of the general inventive concept may also include a developing cartridge usable in an image forming apparatus, the developing cartridge comprising: a tubular member; a shaft extending through the tubular member and to apply a charging voltage to be transferred to a photoconductive body in contact with the tubular member, the shaft including a protrusion at a middle portion thereof; a current carrying member disposed inside the tubular member and connected to the shaft to transfer the voltage of the shaft to the tubular member; and a damping member disposed between the shaft and the current carrying member such that the current carrying member contacts the tubular member at the area of the protrusion.

In an embodiment, the protrusion is formed by increasing a thickness of the shaft toward the middle portion thereof.

In an embodiment, the protrusion is formed by the shaft being convexly curved in a direction facing the photoconductive body.

In an embodiment, the protrusion is formed by a lower side of the middle portion of the shaft being thicker than opposite end portions thereof.

Embodiments of the general inventive concept may also include a developing cartridge usable in an image forming apparatus, the developing cartridge comprising: a tubular member; a shaft extending through the tubular member and to apply a charging voltage to be transferred to a photoconductive body in contact with the tubular member; a current carrying member disposed inside the tubular member and connected to the shaft to transfer the voltage of the shaft to the tubular member, the current carrying member being formed convexly such that a middle portion thereof is disposed more closely to the photoconductive body than opposite end portions thereof in a longitudinal direction parallel to a central axis of the shaft; and a damping member disposed between the shaft and the current carrying member.

Embodiments of the general inventive concept may also include a developing cartridge usable in an image forming apparatus, the developing cartridge comprising: a tubular member; a shaft extending through the tubular member and to apply a charging voltage to be transferred to a photoconductive body in contact with the tubular member; and a damping member connected to the shaft and extending in a longitudinal direction parallel with a central axis of the shaft, the damping member being formed convexly such that a middle portion thereof is disposed more closely to the photoconductive body than opposite end portions thereof.

In an embodiment, the shaft includes a protrusion at the middle portion thereof being in a range of about 0.14 mm-0.35 mm.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
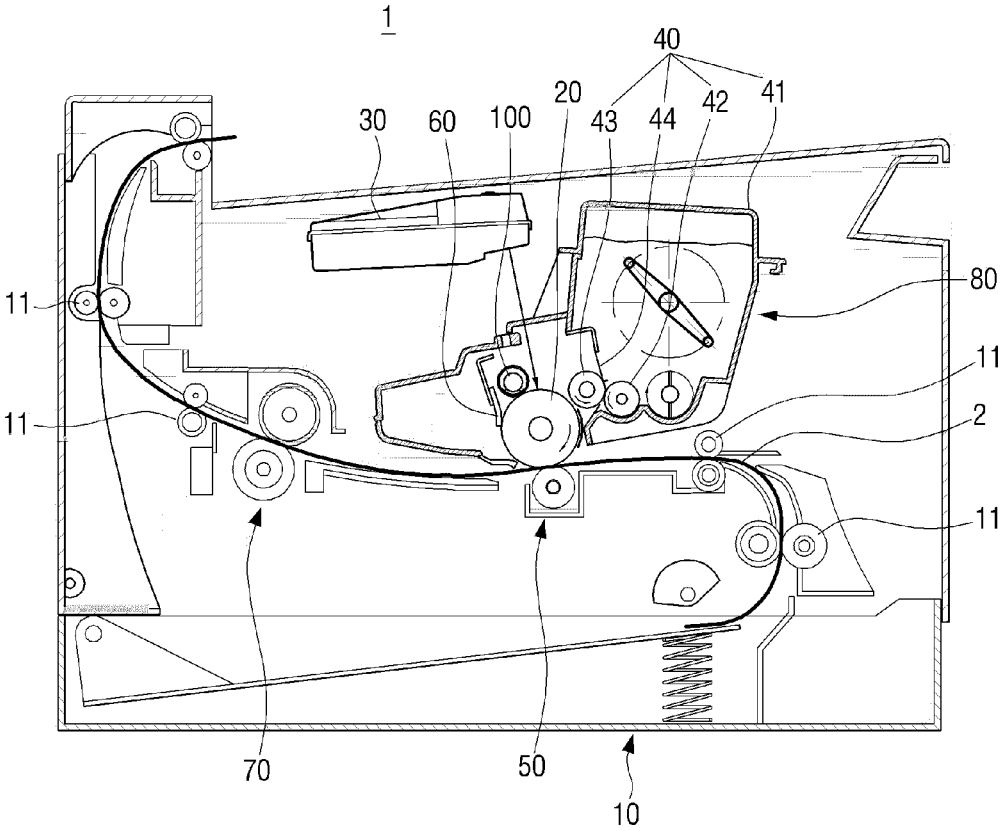
FIG. 1 is a schematic cross-sectional view of an image forming apparatus equipped with a developing cartridge according to an exemplary embodiment.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic cross-sectional view of an image forming apparatus equipped with a developing cartridge according to an exemplary embodiment. Such an image forming apparatus 1 may be various devices such as a printer, a facsimile, a copier, or a multifunction peripheral (MFP), which form a prescribed image on a print medium. Reference numeral 2 in FIG. 1 indicates a progress path of the print medium.

A paper feeding unit 10 may store a print medium such as paper. The print medium is transferred along a progress path 2 by a plurality of progress rollers 11.

A charging unit 100 may charge a surface of a photoconductive body 20 to a prescribed electric potential using a contact charging system. The charging unit 100 is described in detail below.

A laser scanning unit 30 may form an electrostatic latent image corresponding to the printing data on the surface of the photoconductive body 20 by scanning the surface of the photoconductive body 20 with a laser.

A developing unit 40 may form a toner image by providing toner to the surface of the photoconductive body 20 on which the electrostatic latent image is formed. The developing unit 40 may comprise a toner storage section 41, a toner supply roller 42, a developing roller 43, and a restriction blade 44.

The toner storage section 41 may store toner therein. The toner supply roller 42 supplies the developing roller 43 with the toner stored in the toner storage section 41, and thus a toner layer is formed on the developing roller 43. The restriction blade 44 makes the toner layer on the developing roller 43 uniform. The toner layer on the developing roller 43 moves onto the electrostatic latent image formed on the surface of the photoconductive body 20 as a result of the potential difference so as to form a toner image.

A transfer unit 50 may transfer the toner image formed on the surface of the photoconductive body 20 to the print medium.

A cleaning unit 60 may remove residual toner from the surface of the photoconductive body 20 after the transfer process.

A fixing unit 70 may fix the toner image transferred to the print medium. The print medium to which the toner image is fixed is discharged outside the image forming apparatus 1 by a plurality of progress rollers 11.

A developing cartridge 80 may integrally comprise components such as the charging unit 100, the photoconductive body 20 and the developing unit 40. After the image forming apparatus 1 is used for a certain period of time, a user may remove a developing cartridge 80 and install a new developing cartridge in the image forming apparatus 1. According to the present exemplary embodiment, there is the toner storage section 41 in the developing cartridge 80, while according to other exemplary embodiments, there may not be the toner storage section 41 in the developing cartridge 80. In other words, in an alternative, there may be a separate toner cartridge which stores toner and the separate toner cartridge may couple to the developing cartridge 80. In this case, the user may replace the toner cartridge and the developing cartridge 80 separately and individually.

Figure 2:
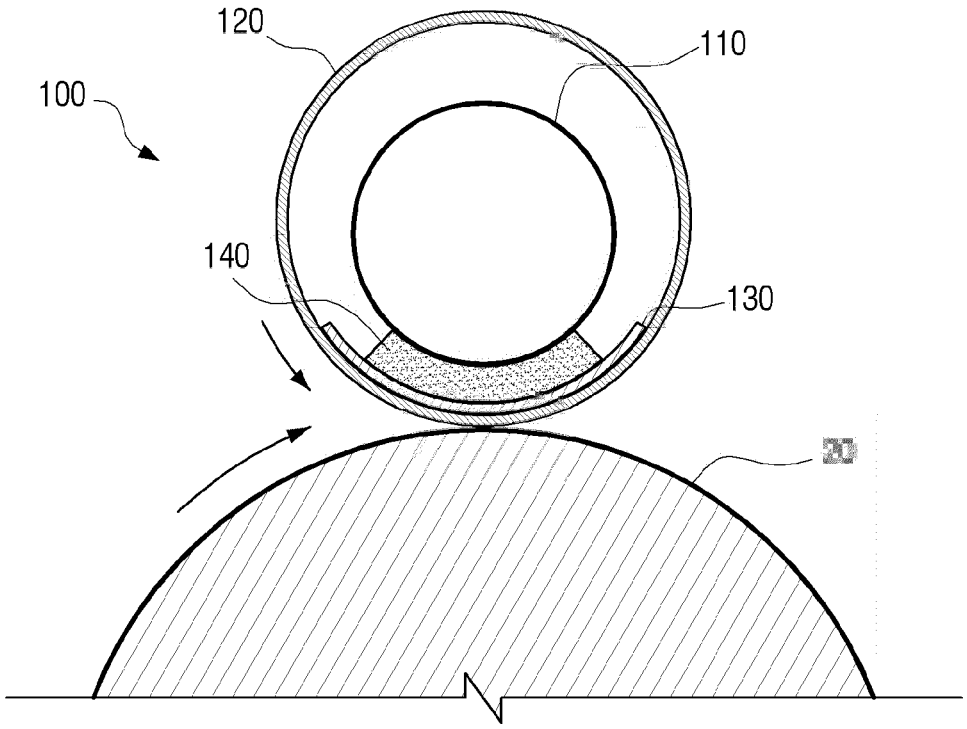
FIG. 2 is a schematic view of a charging unit according to the exemplary embodiment of FIG. 1.
Figure 3:
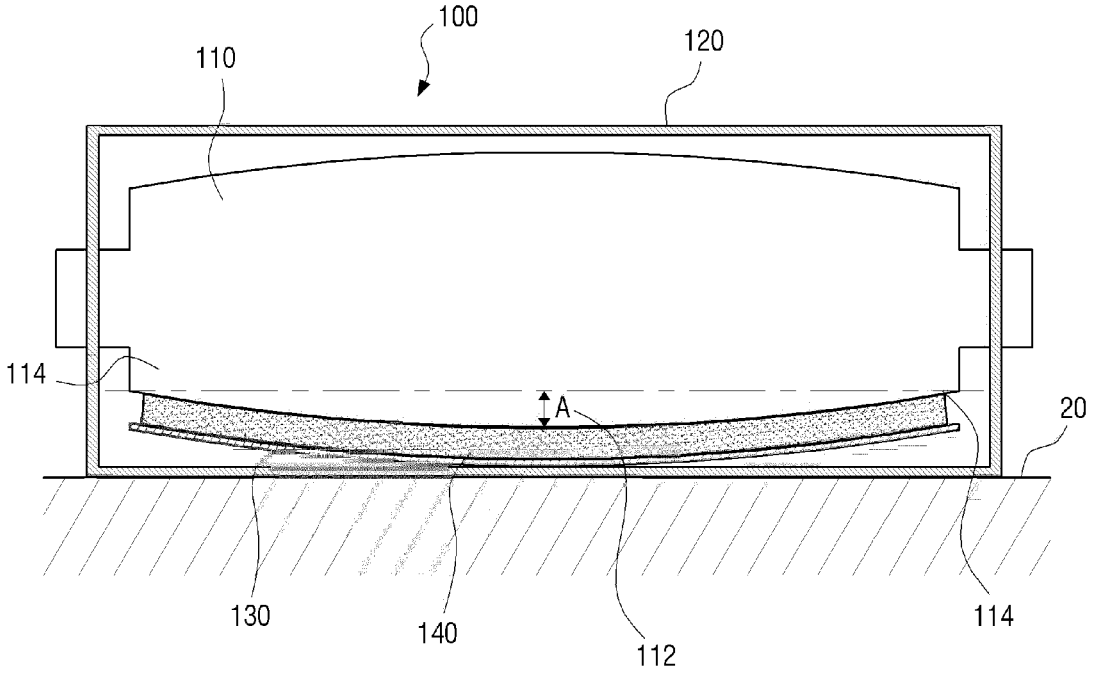
FIG. 3 is a schematic cross-sectional view of a charging unit according to the exemplary embodiment of FIG. 1.
Figure 4:
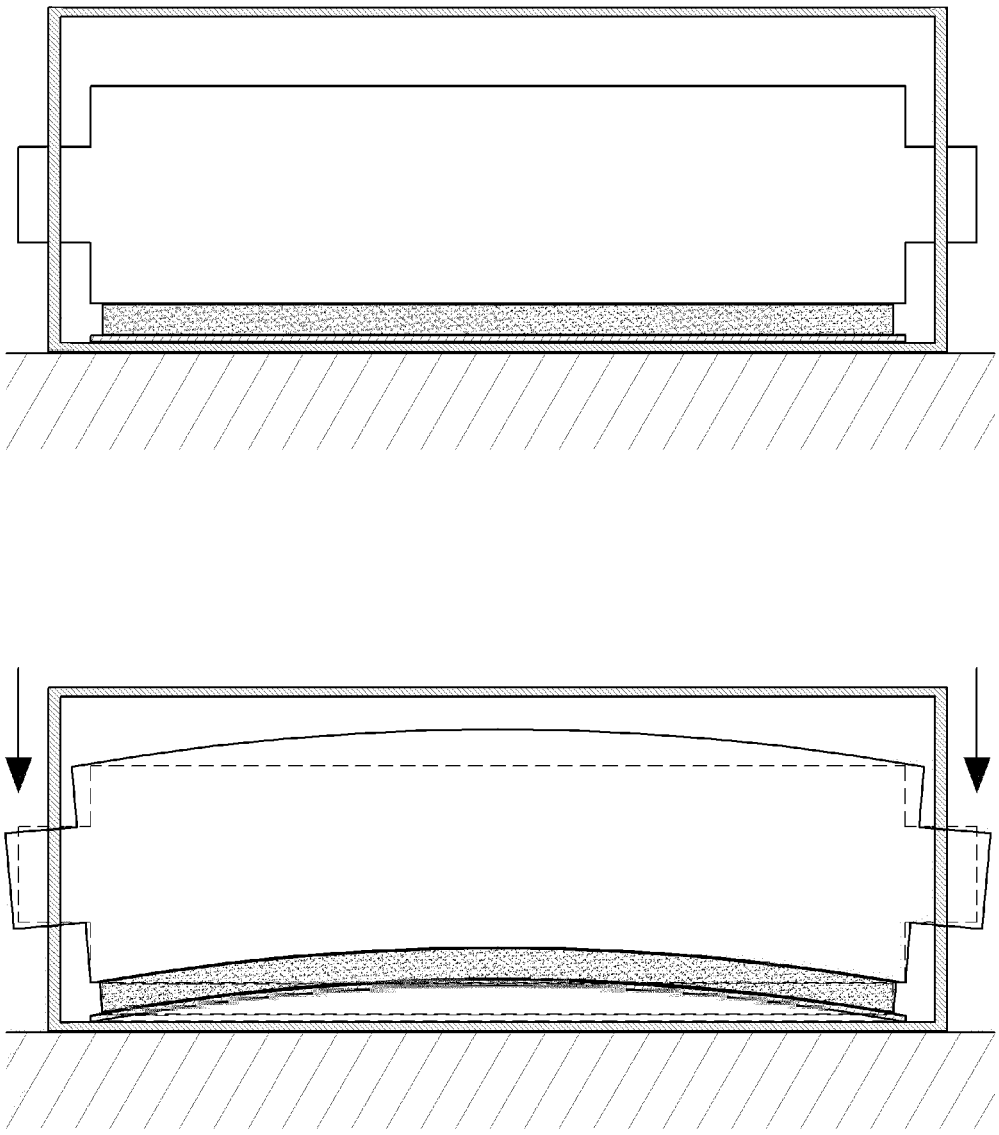
FIG. 4 is a schematic view of excitation between a charging tube and a current carrying member when a charging unit is equipped in an image forming apparatus.
Figure 5:
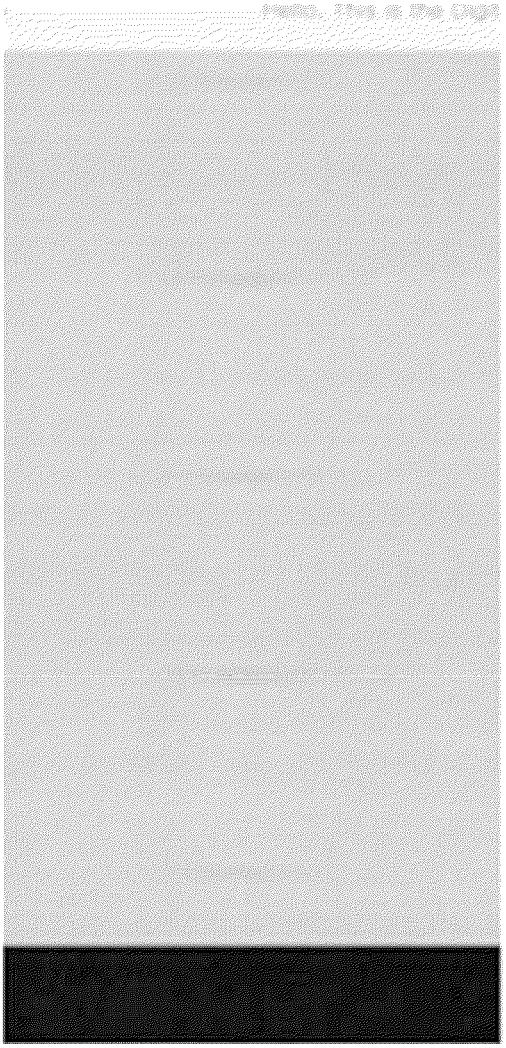
FIG. 5 is a view of images having foggy defects of a tubular period when the excitation of FIG. 4 occurs.
Figure 6:
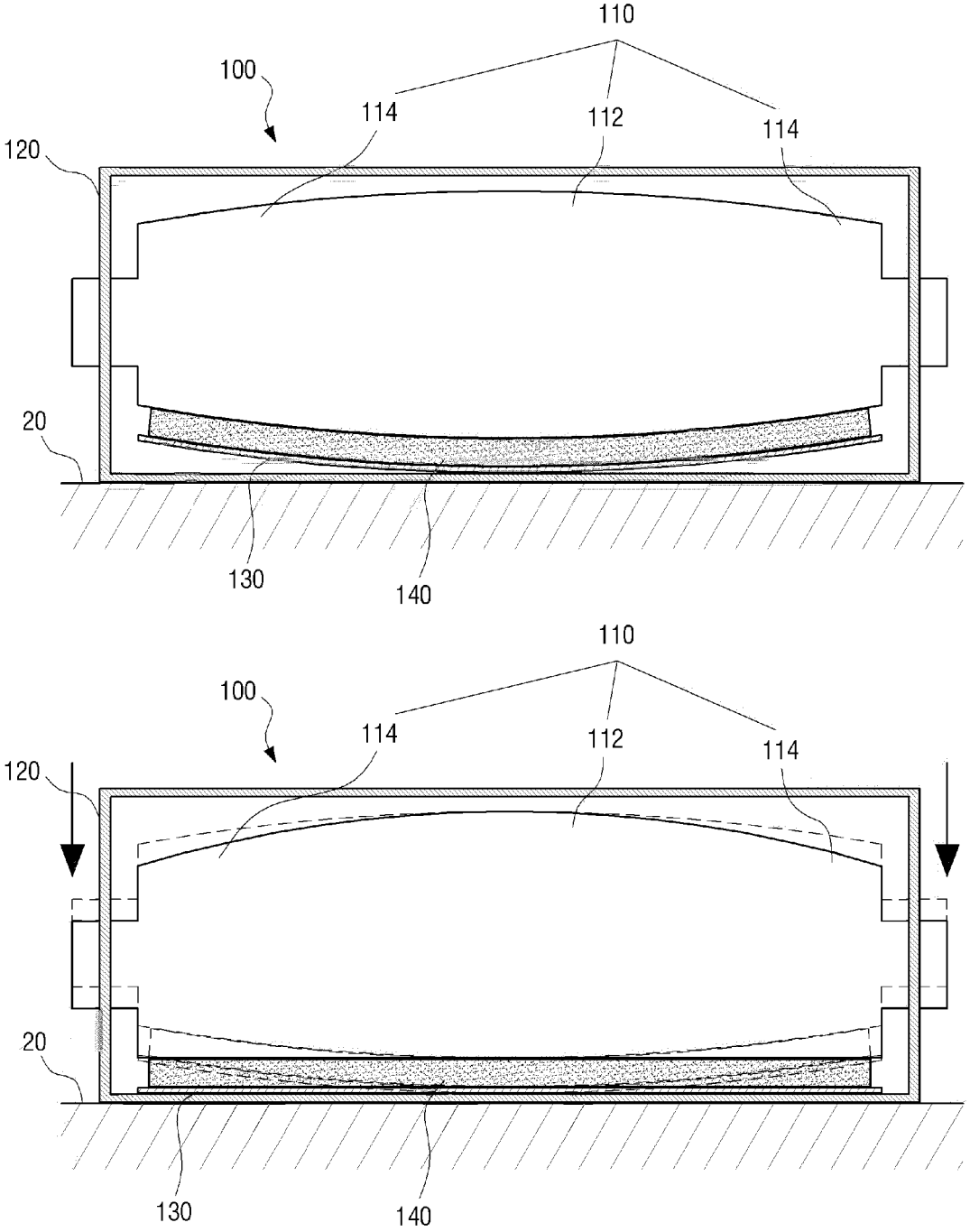
FIG. 6 is a schematic view of installation of a charging unit according to the exemplary embodiment of FIG. 1.

Referring to FIGS. 2 to 6, the charging unit 100 of the developing cartridge 80 according to the present exemplary embodiment is described in great detail. FIG. 2 is a schematic view of the charging unit 100 according to the present exemplary embodiment, FIG. 3 is a schematic cross-sectional view of the charging unit 100 according to the present exemplary embodiment, FIG. 4 is a schematic view of excitation between a charging tube and a current carrying member when a charging unit is equipped in an image forming apparatus, FIG. 5 is a view of images having foggy defects of a tubular period when occurring the excitation of FIG. 4, and FIG. 6 is a schematic view of installation of the charging unit 100 according to the present exemplary embodiment.

The charging unit 100 comprises a shaft 110 applying a charging voltage so as to charge the surface of the photoconductive body 20 from an external power supply (not shown), a tubular member 120 surrounding the shaft 110, which is disposed to be in contact with the surface of the photoconductive body 20, a current carrying member 130 which is disposed on an inner surface of the tubular member 120, and a damping member 140 which is disposed between the shaft 110 and the current carrying member 130.

The shaft 110 has a central axis parallel to a rotating axis of the photoconductive body 20 and is formed in a cylindrical shape. The shaft 110 may have a size of ϕ6*252 mm. The shaft 110 may consist of an injection molding and be formed of a conductive metal material, and for example may be formed of 40% PET and glass fiber (G/F). The shaft 110 may be formed to have a diameter which increases while becoming closer to a middle portion 112, and thus the middle portion 112 is thicker than opposite side portions 114 in a longitudinal direction along the central axis. A protrusion A of the middle portion of the shaft 110 may be in the range of 0.14 mm-0.35 mm in a direction of the photoconductive body 20.

Below is a table showing the image output results according to the protrusion (thickness) by making 3D measurements of the middle portion 112 and the opposite side portions 114 of the shaft 110.

TABLE 1

| | Protrusion of the middle portion in the direction of the photoconductive body (mm) | Image output |
|---|---|---|
| Shaft 1 | 0.0076 | Images having foggy defects of a tubular period |
| Shaft 2 | 0.1358 | Satisfactory |
| Shaft 3 | 0.2010 | Satisfactory |
| Shaft 4 | 0.3478 | Satisfactory |

As shown in the above table, if the protrusion of the middle portion of the shaft 110 is formed in the range as described above, no foggy defect is formed in portions of images at the time of the tubular period.

The tubular member 120 has a hollow shape, which has a hollow interior. The tubular member 120 may have a size of ϕ8.5*241 mm. The tubular member 120 may be formed of nylon and conductive additives such as carbon black, an ionic conductor and the like. As the photoconductive body 20 rotates, the tubular member 120 also rotates by a frictional force produced between the tubular member 120 and the photoconductive body 20.

The current carrying member 130 is connected to the shaft 110 and is in contact with the inner surface of the tubular member 120. The current carrying member 130 may be formed in a shape of a thin film. The current carrying member 130 may have a size of 1.1t*6 mm*226 mm. The current carrying member 130 is preferable to have a surface resistance of $10^8\Omega$. The current carrying member 130 may be formed of flexible and conductive materials, and conductive UHMW-PE may be employed. A length of the current carrying member 130 is formed to be longer than that of the damping member 140 so that the damping member 140 may not be in direct contact with the inner surface of the tubular member 120. The charging voltage applied to the shaft 110 may be transferred to the tubular member 120 through the current carrying member 130.

The damping member 140 applies pressure to the tubular member 120 and the current carrying member 130 towards the photoconductive body 20. It is possible for the photoconductive body 20 and the tubular member 120 to be in stable contact with each other with the aid of the damping member 140. To this end, the damping member 140 may be formed of an elastic member which has elasticity as foam, and may be, for example, formed of a sponge with #711G of BOW employed therein.

The materials and shapes of the shaft 110, the tubular member 120, the current carrying member 130 and the damping member 140 as described above are simply exemplified, and it should be understood that the above materials and shapes may be variable.

The charging voltage applied to the shaft 110 is transferred to the tubular member 120 through the current carrying member 130, and thus a discharge is produced in a wedge-shaped minute gap between an outer surface of the tubular member 120 and the photoconductive body 20. The photoconductive body 20 is a non-conductor of electricity, but due to such a discharge, a surface potential may be formed on the surface of the photoconductive body 20. The charging voltage applied to the shaft 110 may be an AC voltage, a DC voltage or a mixture of the AC voltage and the DC voltage. Such a charging voltage can be easily understood by those skilled in the art, and thus a detailed explanation is omitted.

By the above described discharge, the charging unit 100 may generate noise, and in particular if the charging voltage is applied in the form of the AC voltage, the noise can be loud. In order to reduce such noise, the charging unit 100 of the developing cartridge 80 according to the present exemplary embodiment does not use a charging roller but the hollow tubular member 120. This is because the tubular member 120 is more flexible than the charging roller, and therefore the noise generated by the discharge can be reduced.

Further, since a part of low molecular weight materials which constitute the charging roller spreads to a photoconductive body, a charging unit using the charging roller may contaminate the photoconductive body. The contaminated photoconductive body causes deterioration in image quality.

The spread accelerates further as a contact force increases between the charging roller and the photoconductive body. The charging unit 100 according to the present exemplary embodiment uses the hollow tubular member 120, not the charging roller, and thus the mass of the tubular member 120 is considerably less than that of the charging roller. Accordingly, the contact force decreases between the photoconductive body 20 and the tubular member 120, and this can prevent the spread of low molecular weight materials.

Hereinafter, it is described how the charging unit 100 of the developing cartridge 80 according to the present exemplary embodiment is equipped in an image forming apparatus.

As illustrated in FIGS. 4 and 5, when a charging unit is installed in an image forming apparatus, pressure is applied to opposite end portions of the charging unit in an arrow direction to provide a charge contact with a photoconductive body. If the pressure is applied to the opposite end portions, as illustrated in FIG. 4, the opposite end portions of the charging unit plays a role as a fulcrum of a lever, and thus a middle portion of the charging unit is bent toward an upper side. Due to such a curve, an excitation occurs in portions between a charging unit and a photoconductive body, and this leads to an unstable contact. As illustrated in FIG. 5, the excitation occurring between the charging unit and the photoconductive body results in foggy defects formed in portions of an image at the time of a tubular period.

As illustrated in FIG. 6, since a thickness of the middle portion 112 of the shaft 110 is greater than that of the opposite end portions 114, the middle portion 112 of the charging unit 100 according to the present exemplary embodiment is not excited from the photoconductive body 20 even though the opposite end portions are pressed by the pressure (in an arrow direction) applied to the opposite end portions of the charging unit 100 when the charging unit 100 is installed. Since the pressure is applied continuously to the opposite end portions of the charging unit 100 in the direction illustrated by arrows for charge contact with the photoconductive body 20, the opposite end portions are also not excited from the photoconductive body 20. Therefore, the charging unit 100 is in a uniform contact with the photoconductive body 20, and thus a uniform image can be obtained without faulty images.

Figure 7:
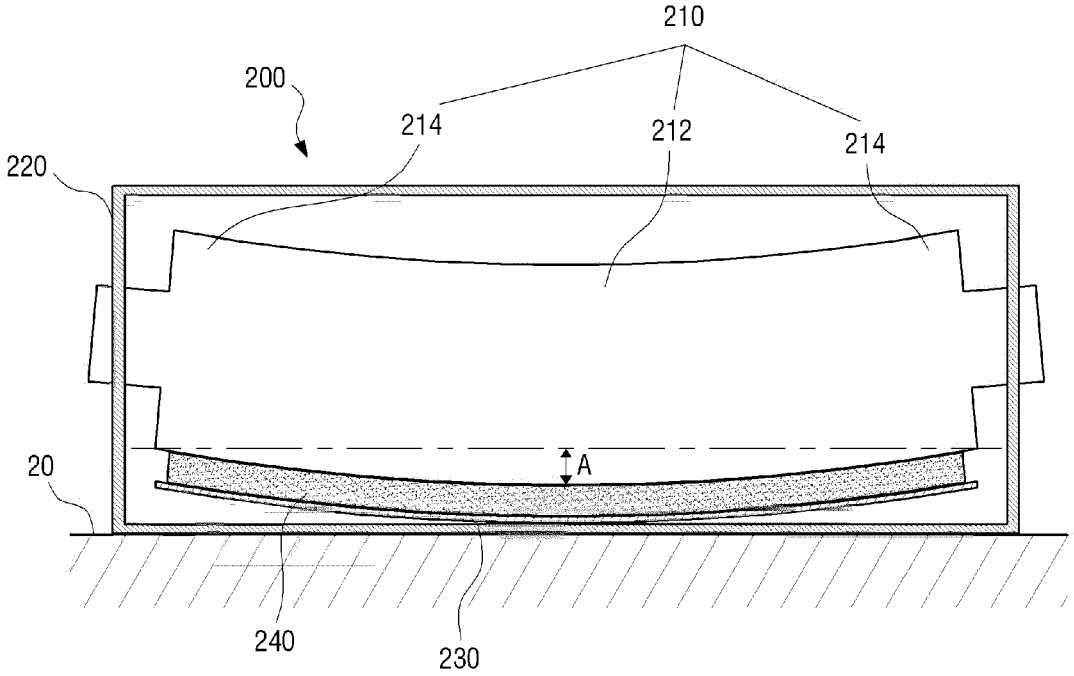
FIG. 7 is a schematic cross-sectional view of a charging unit according to another exemplary embodiment.
Figure 8:
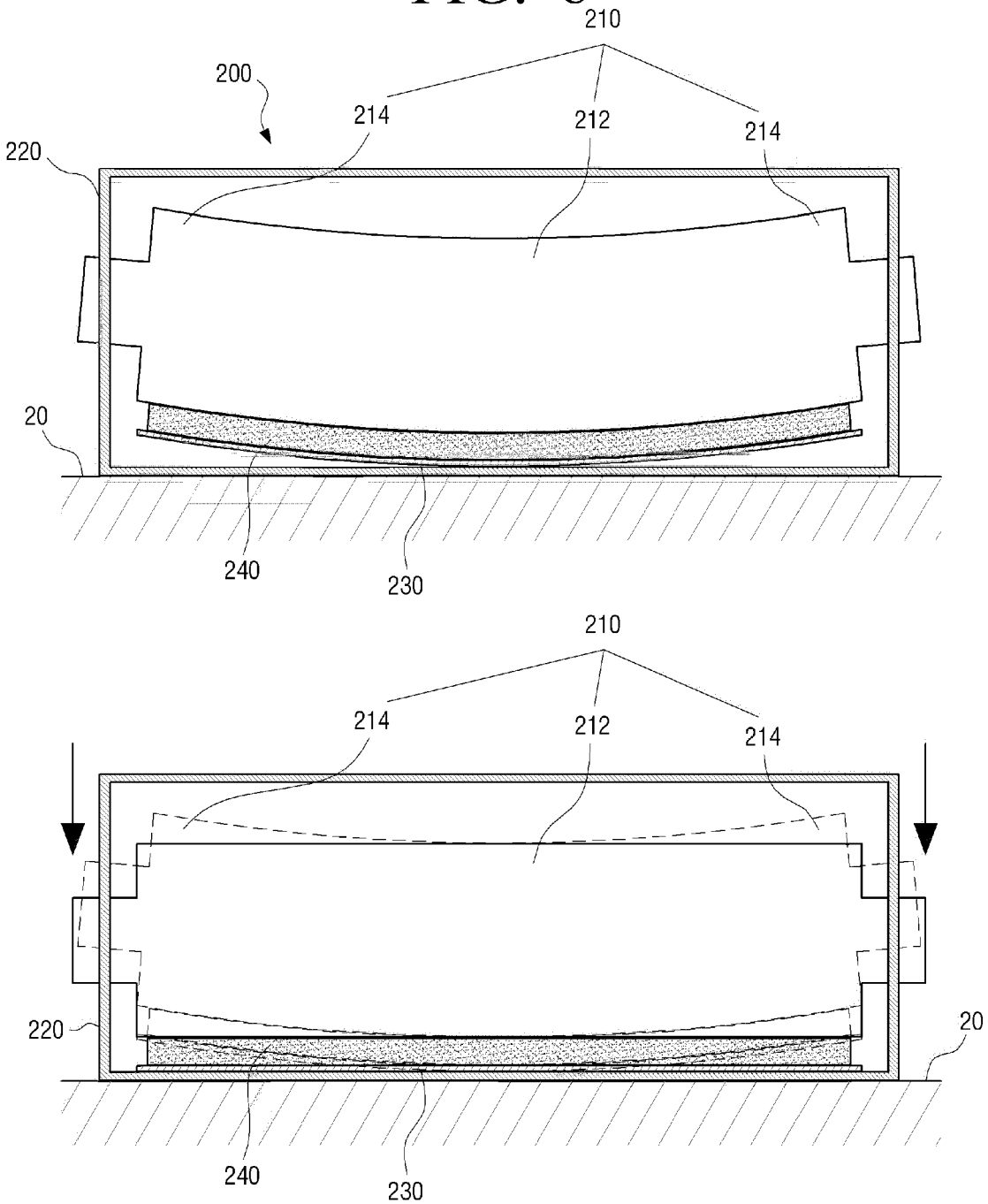
FIG. 8 is a schematic view of installation of a charging unit according to the exemplary embodiment of FIG. 7.

Hereinafter, a charging unit according to another exemplary embodiment is described as follows:

FIG. 7 is a schematic cross-sectional view of a charging unit according to another exemplary embodiment and FIG. 8 is a schematic view of installation of the charging unit according to the exemplary embodiment of FIG. 7.

The charging unit 200 according to the present exemplary embodiment is similar to the charging unit 100 according to the previously described exemplary embodiment. For example, a tubular member 220, a current carrying member 230 and a damping member 240 of the charging unit 200 are identical to those of the above described charging unit 100. Therefore, the components of the charging unit 200 are not explained again.

As illustrated in FIG. 7, a shaft 210 is formed windingly so that a middle portion 212 is disposed more closely to the photoconductive body 20 than opposite end portions 214 in a longitudinal direction along a central axis of the photoconductive body 20. In other words, the shaft 210 is formed to be convexly curved in a direction of facing the photoconductive body 20.

A protrusion (A) of the middle portion 212 of the shaft 210 is preferable to be in the range of 0.14 mm-0.35 mm in a direction of the photoconductive body 20 as described in the above exemplary embodiment.

Hereinafter, an installation of the charging unit 200 according to the present exemplary embodiment is described as follows: As illustrated in FIG. 8, if the charging unit 200 is installed in an image forming apparatus, as described in the previous exemplary embodiment, pressure is applied to opposite end portions of the charging unit 200 in a direction of arrows. By the pressure applied to the opposite end portions, the opposite end portions 214 are pressed toward the direction of the photoconductive body 20, and thus the curve of the shaft 210 is straightened and a uniform contact is secured between the charging unit 200 and the photoconductive body 20. Therefore, as described in the previous exemplary embodiment, due to the uniform contact with the photoconductive body 20, the charging unit 200 can provide uniform images without fogging or other problems.

Figure 9:
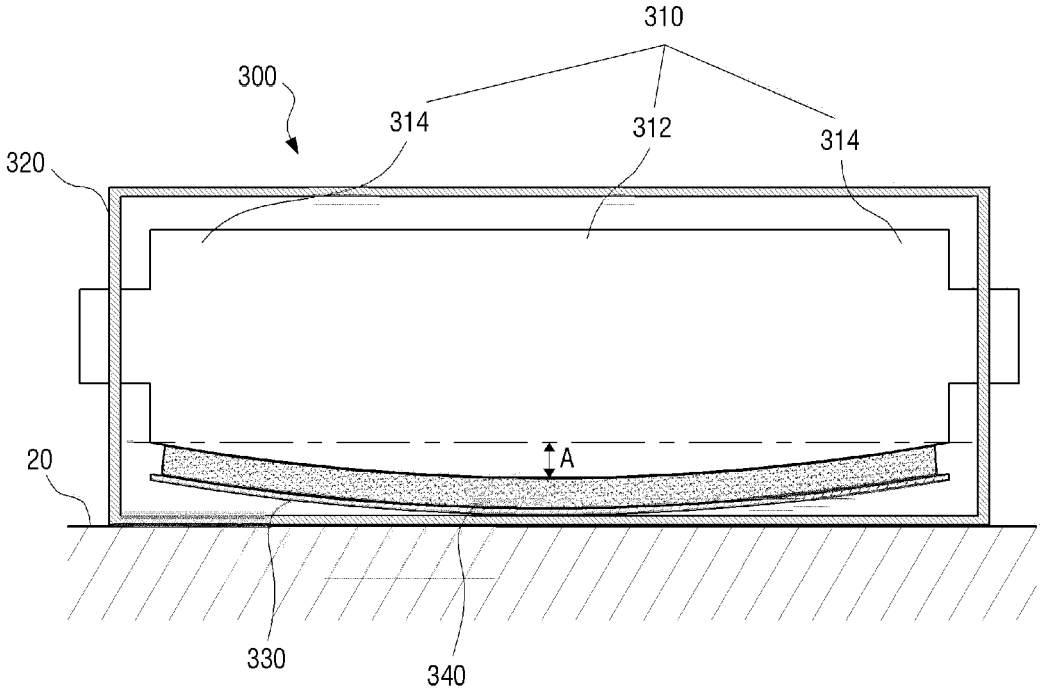
FIG. 9 is a schematic cross-sectional view of a charging unit according to yet another exemplary embodiment.

Hereinafter, a charging unit according to yet exemplary embodiment is described as follows:

FIG. 9 is a schematic cross-sectional view of a charging unit according to another exemplary embodiment.

The charging unit 300 according to the exemplary embodiment of FIG. 9 is similar to the charging unit 100 according to the previously described exemplary embodiment. For example, a tubular member 320, a current carrying member 330 and a damping member 340 of the charging unit 300 are identical to those of the above described charging unit 200. Therefore, the components of the charging unit 300 will not be repeated again below in order to ensure brevity and conciseness of this application.

As illustrated in FIG. 9, a lower side of a middle portion 312 of a shaft 310, which is close to the photoconductive body 20, is formed to be thicker than opposite end portions 314, and a protrusion (A) of the middle portion 312 of the shaft 310 is preferable to be in the range of 0.14 mm-0.35 mm in a direction of the photoconductive body 20 as described in the above exemplary embodiment. Herein, an upper side of the middle portion 312 is formed evenly and collinearly with respect to the opposite end portions 314. In case that the charging unit 300 is installed in an image forming apparatus to provide a contact charge, as described in the above exemplary embodiment, since pressure is applied to opposite end portions in a direction of facing a photoconductive body, no inconvenience is caused in making a uniform contact between the charging unit 300 and the photoconductive body 20 although the upper side of the shaft 310 is not formed convexly. Since a thickness of the middle portion 312 is not necessarily greater than the opposite end portions 314 in the upper side of the shaft 310 of the charging unit 300 according to the exemplary embodiment, manufacturing efficiency of the shaft 310 increases.

Figure 10:
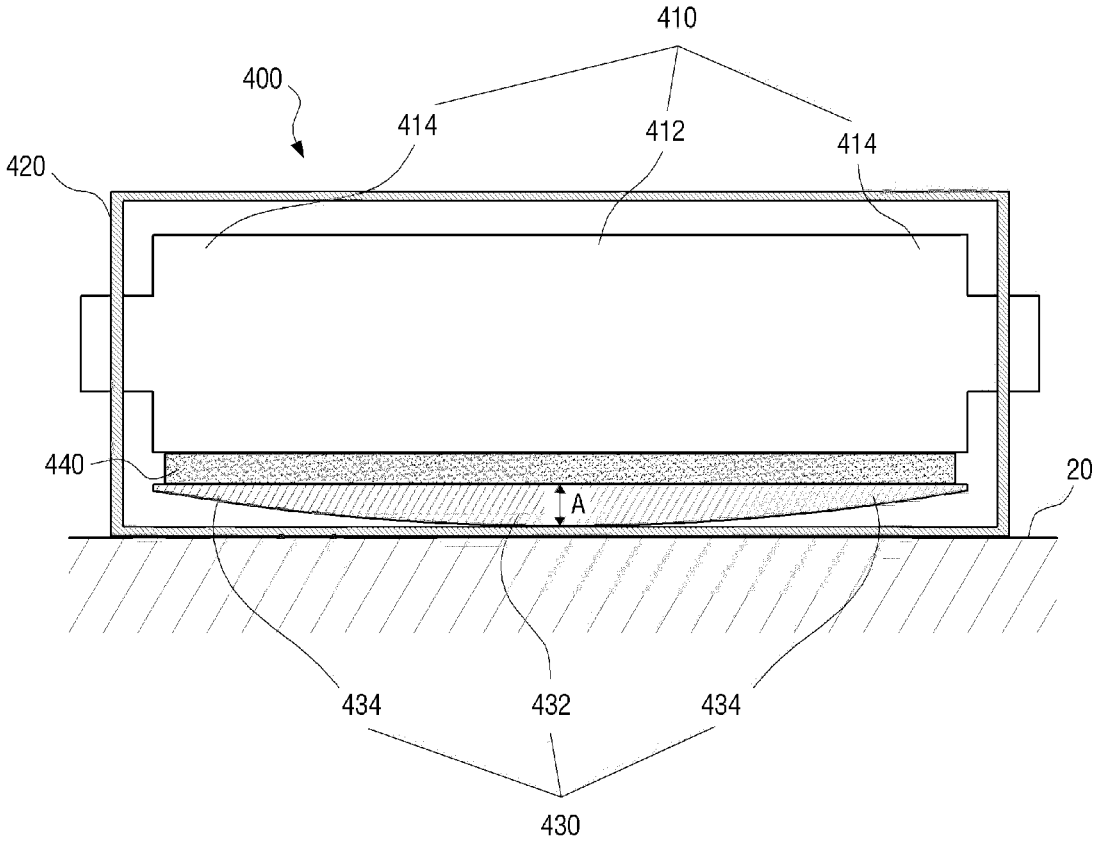
FIG. 10 is a schematic cross-sectional view of a charging unit according to still another exemplary embodiment.

Hereinafter, a charging unit according to yet another exemplary embodiment is described as follows:

FIG. 10 is a schematic cross-sectional view of a charging unit according to another exemplary embodiment.

The charging unit 400 according to this exemplary embodiment is similar to the charging unit 100 according to the above described previous exemplary embodiment. For example, a tubular member 420 and a damping member 440 of the charging unit 400 are the same as those of the above described charging unit 100. Therefore, the components of the charging unit 400 will not be repeated again below in order to ensure brevity and conciseness of this application.

Upper and lower sides of a middle portion 412 and opposite end portions 414 are formed evenly and collinearly with respect to one another in a shaft 410.

A current carrying member 430 is formed convexly so that a middle portion 432 may be disposed more closely to a photoconductive body than opposite end portions 434 in a longitudinal direction parallel to a central axis of the shaft 410.

A protrusion (A) of the middle portion 432 of the current carrying member 430 is preferable to be in the range of 0.14 mm-0.35 mm in a direction of the photoconductive body 20 in the same manner of the middle portion of the shaft as described in the above exemplary embodiment. Therefore, the charging unit 400 according to this exemplary embodiment can achieve the same effect as the charging unit in which the middle portion of the above described shaft is thick without forming the shaft 410 to be convex.

Figure 11:
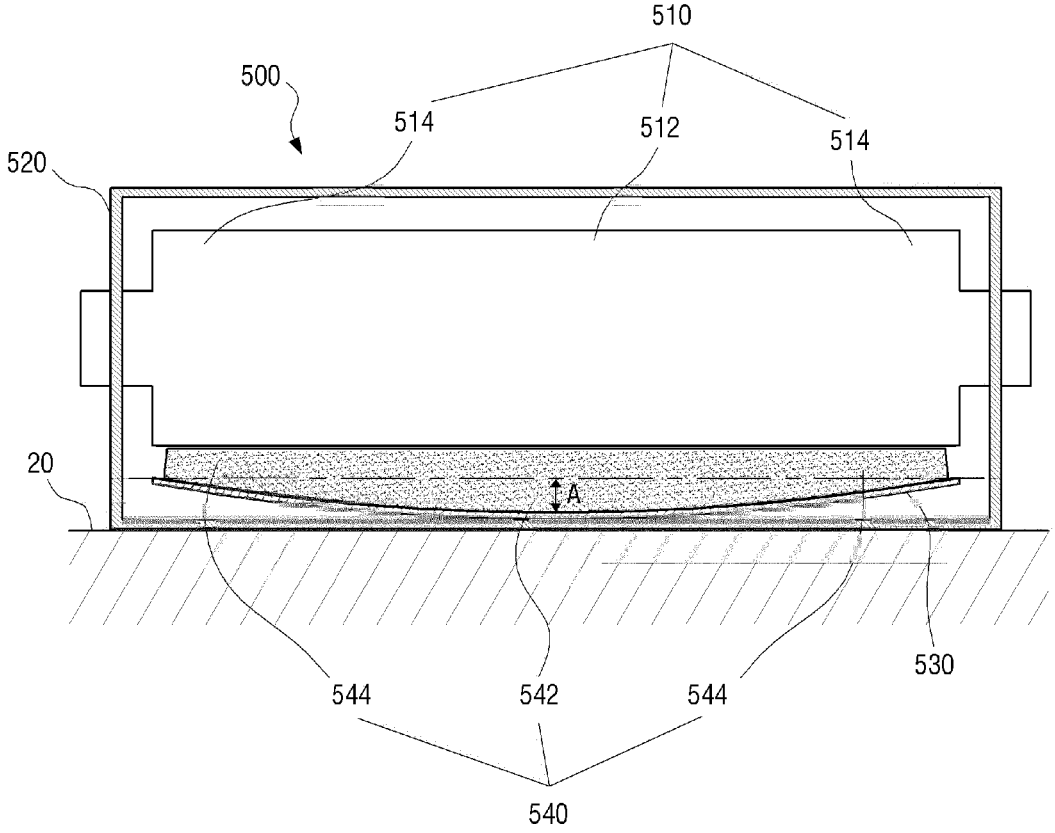
FIG. 11 is a schematic cross-sectional view of a charging unit according to still another exemplary embodiment.

Hereinafter, a charging unit according to still another exemplary embodiment is described as follows:

FIG. 11 is a schematic cross-sectional view of a charging unit according to still another exemplary embodiment.

The charging unit 500 according to the exemplary embodiment of FIG. 11 is similar to the charging unit 100 according to the above described exemplary embodiment. For example, a tubular member 520 and a current carrying member 530 of the charging unit 500 are identical to those of the above described charging unit 100. Therefore, the components of the charging unit 500 will not be repeated again below in order to ensure brevity and conciseness of this application.

Upper and lower sides of a middle portion 512 and opposite end portions 514 are formed evenly and collinearly with respect to one another in a shaft 510.

A damping member 540 is formed convexly so that a middle portion 542 may be disposed more closely to the photoconductive body 20 than opposite end portions 544 in a longitudinal direction parallel to a central axis of the shaft 510.

A protrusion (A) of the middle portion 542 of the damping member 540 is preferable to be in the range of 0.14 mm-0.35 mm in a direction of the photoconductive body 20 in the same manner of the middle portion of the shaft as described in the previous exemplary embodiment. Therefore, the charging unit 500 according to the exemplary embodiment can achieve the same effect as the charging unit in which the middle portion of the above described shaft is thick without forming the shaft 510 to be convex.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing cartridge comprising a photoconductive body, a charging unit which charges a surface of the photoconductive body and a developing unit which forms a toner image by supplying the surface of the photoconductive body with toner, wherein the charging unit comprises:

a shaft which applies a charging voltage and which has a central axis parallel to a rotating axis of the photoconductive body, the shaft having a middle portion which is thicker than opposite end portions in a longitudinal direction along the central axis;

a tubular member formed of a conductive material which surrounds the shaft and which is disposed to be in contact with the surface of the photoconductive body;

a current carrying member which is disposed on a surface of an inner side of the tubular member and which applies an electric current to the shaft and the tubular member, the tubular member rotating relative to the current carrying member; and a damping member which is disposed between the shaft and the current carrying member.

2. The developing cartridge as claimed in claim 1, wherein the shaft is formed in a cylindrical shape and a diameter of the shaft increases toward the middle portion thereof.

3. The developing cartridge as claimed in claim 2, wherein a protrusion of the middle portion of the shaft is in the range of 0.14 mm-0.35 mm in a direction of the photoconductive body.

4. The developing cartridge as claimed in claim 1, wherein the shaft consists of an injection molding.

5. The developing cartridge as claimed in claim 1, wherein the tubular member is formed of conductive nylon.

6. The developing cartridge as claimed in claim 1, wherein the current carrying member has a surface resistance of less than $10^8\Omega$.

7. The developing cartridge as claimed in claim 1, wherein the damping member is an elastic member having elasticity.

8. The developing cartridge as claimed in claim 7, wherein the damping member consists of foam.

9. A developing cartridge usable in an image forming apparatus, the developing cartridge comprising:

a tubular member;

a shaft extending through the tubular member and to apply a charging voltage to be transferred to a photoconductive body in contact with the tubular member, the shaft including a protrusion at a middle portion thereof;

a current carrying member disposed inside the tubular member and connected to the shaft to transfer the voltage of the shaft to the tubular member, the tubular member rotating relative to the current carrying member; and a damping member disposed between the shaft and the current carrying member such that the current carrying member contacts the tubular member at the area of the protrusion.

10. The developing cartridge as claimed in claim 9, wherein the protrusion is formed by increasing a thickness of the shaft toward the middle portion thereof.

11. The developing cartridge as claimed in claim 9, wherein the protrusion is formed by the shaft being convexly curved in a direction facing the photoconductive body.

12. The developing cartridge as claimed in claim 9, wherein the protrusion is formed by a lower side of the middle portion of the shaft being thicker than opposite end portions thereof.

13. The developing cartridge as claimed in claim 9, wherein the protrusion of the middle of the shaft is in a range of about 0.14 mm-0.35 mm.

14. The developing cartridge as claimed in claim 9, wherein a length of the current carrying member is longer than that of the damping member such that the damping member cannot make direct contact with the inner surface of the tubular member.

15. A developing cartridge usable in an image forming apparatus, the developing cartridge comprising:

a tubular member;

a shaft extending through the tubular member and to apply a charging voltage to be transferred to a photoconductive body in contact with the tubular member;

a current carrying member disposed inside the tubular member and connected to the shaft to transfer the voltage of the shaft to the tubular member, the current carrying member being formed convexly such that a middle portion thereof is disposed more closely to the photoconductive body than opposite end portions thereof in a longitudinal direction parallel to a central axis of the shaft, the tubular member rotating relative to the current carrying member; and a damping member disposed between the shaft and the current carrying member.

16. The developing cartridge as claimed in claim 15, wherein a protrusion of the middle portion of the current carrying member is in a range of about 0.14 mm-0.35 mm.

17. The developing cartridge of claim 1, wherein a length of the current carrying member in a circumferential direction of the tubular member is less than the inner circumference of the tubular member.

* * * * *